US007236099B2

(12) United States Patent
Schult

(10) Patent No.: US 7,236,099 B2
(45) Date of Patent: Jun. 26, 2007

(54) HOUSEHOLD APPLIANCE WITH USER INTERFACE WITH BI-COLORED LEDS

(75) Inventor: Denise L. Schult, Newton, IA (US)

(73) Assignee: Maytag Corporation, Newton, IA (US)

( * ) Notice: Subject to any disclaimer, the term of this patent is extended or adjusted under 35 U.S.C. 154(b) by 165 days.

(21) Appl. No.: 11/096,538

(22) Filed: Apr. 1, 2005

(65) Prior Publication Data

US 2006/0220899 A1 Oct. 5, 2006

(51) Int. Cl.
*G08B 5/22* (2006.01)

(52) U.S. Cl. ..... 340/815.45; 340/679; 700/22; 700/27; 700/293

(58) Field of Classification Search ..... 340/644, 340/540, 679, 815.45; 210/87, 109, 134; 700/22, 27, 293
See application file for complete search history.

(56) References Cited

U.S. PATENT DOCUMENTS 4,195,500 A 4/1980 Tobita
4,245,310 A * 1/1981 Kiefer ..... 700/90
4,837,565 A * 6/1989 White ..... 345/46
4,977,394 A 12/1990 Manson
4,982,468 A 1/1991 Takahashi
5,038,586 A 8/1991 Nukaga
5,369,416 A 11/1994 Haverty
5,392,618 A 2/1995 Livingston
5,464,955 A 11/1995 Cole
5,493,877 A 2/1996 Wickremasinghe
6,164,374 A 12/2000 Rhodes
6,255,960 B1 7/2001 Ahne
6,381,503 B1 * 4/2002 Dollhopf et al. ..... 700/22
2002/0189983 A1 * 12/2002 Guess et al. ..... 210/87

FOREIGN PATENT DOCUMENTS

JP 407059978 A 3/1995

* cited by examiner

*Primary Examiner*—Brent A. Swarthout
(74) *Attorney, Agent, or Firm*—McKee, Voorhees & Sease, P.L.C.

(57) ABSTRACT

A household appliance, includes an appliance cabinet, an appliance user interface having multiple settings. Each setting has multiple selection options. There is a bi-color LED associated with each of the selection options. The bi-colored LEDs are used to indicate the current settings of the appliance and the availability of appliance selection options. The bi-colored LEDs can also be used to provide feedback during programming of the settings of the household appliance.

13 Claims, 3 Drawing Sheets

HOUSEHOLD APPLIANCE WITH USER INTERFACE WITH BI-COLORED LEDS

BACKGROUND OF THE INVENTION

The present invention relates to household appliances, and more particularly, but not exclusively to the user interface and controls for a household appliance. It is desirable that appliances be easy to operate. However, as the number of available options and controls associated with, for example, washing machines, have increased. The use of a washing machine has also become more complicated for operators. This invention is contemplated to be used on all types of household appliances. However, the remainder of the examples relate to washing machines. It is advantageous to show washing machines as examples for this invention due to their control/cycling/programming nature. In other words, since washing machines have many combinations of operation, they are good examples to show the breadth of this invention.

Also, washing machine user interfaces have historically been mechanically based systems. Thus, an operator could make their selection of settings such as by turning a selector associated with a knob or pushing in buttons. As control systems for the washing machine have moved to digital controls, a need for a user interface that not only allows a user to set the controls but also displays the status of the controls is needed.

Therefore, it is a primary object, feature, or advantage of the present invention to improve upon the state of the art.

It is a further object, feature, or advantage of the present invention to provide an appliance with an improved user interface.

A still further object, feature, or advantage of the present invention is an appliance that has an easy to use user interface.

Yet another object, feature, or advantage of the present invention is an appliance that has programmable user settings.

A still further object, feature, or advantage of the present invention is an appliance that allows an operator to determine which function selections are available while the appliance is in operation.

One or more of these and/or other objects, features, or advantages of the present invention become apparent from the specification and claims that follow.

SUMMARY OF THE INVENTION

The present invention uses bi-color LEDs on an appliance interface. According to one aspect of the present invention, there are multiple bi-color LEDs on the user interface of an appliance. The color state of the LED is used to indicate whether a particular selection option is or is not available for selection. Thus, an operator of the appliance can determine which options are available by the color state of the LEDs associated with the appliance.

According to another aspect of the present invention, the user interface of the appliance includes a program button. The settings associated with each program are indicated by the color states of the LEDs.

According to another aspect of the present invention, an appliance is disclosed. The appliance includes a cabinet and a user interface. The user interface includes a plurality of selection buttons and a plurality of bi-colored LEDs. Each of the plurality of selection buttons is associated with one of the plurality of bi-colored LEDs. The user interface is adapted to maintain each of the plurality of bi-colored LEDs in either a first color state, a second color state, or an off state.

During programming of a washing machine, for instance, and during the wash cycle, the second color state indicates the washing machine operation associated with the bi-colored LED is not available and the first color state indicates the washing machine operation associated with the bi-colored LED has been selected. Thus, a user can determine which settings can be changed during a washing cycle by the color state of the LEDs.

According to another aspect of the present invention, a method for programming an appliance is disclosed. The method includes receiving a press of a program button from a user to initiate programming. The method then provides for lighting a plurality of LEDs associated with an appliance setting, each LED associated with one of a plurality of setting option buttons. Each LED is a bi-color LED. The methodology then provides for receiving a press of the setting option button to select the appliance setting option LED associated with the appliance setting option. Then, the method provides for turning off all LEDs associated with the appliance setting while maintaining the LED associated with the appliance setting option as lit. Next, the method provides for lighting any LEDs associated with appliance setting selection options made unavailable by the selection made in the receiving step in a second color. Next, the method provides for receiving a second press of the program button from the user to retain the appliance settings.

According to yet another aspect of the present invention, a method of using bi-color LEDs in an appliance user interface is disclosed. The bi-color LEDs are each associated with a selection option. For example, during a wash cycle of a washing machine, the bi-color LEDs associated with options selected are lit to a first color state while the bi-color LEDs associated with options not available for selection are lit to a second color state. The bi-color LEDs associated with options still available for selection during the wash cycle are maintained in an off state.

DETAILED DESCRIPTION OF THE PREFERRED EMBODIMENT

Figure 1:
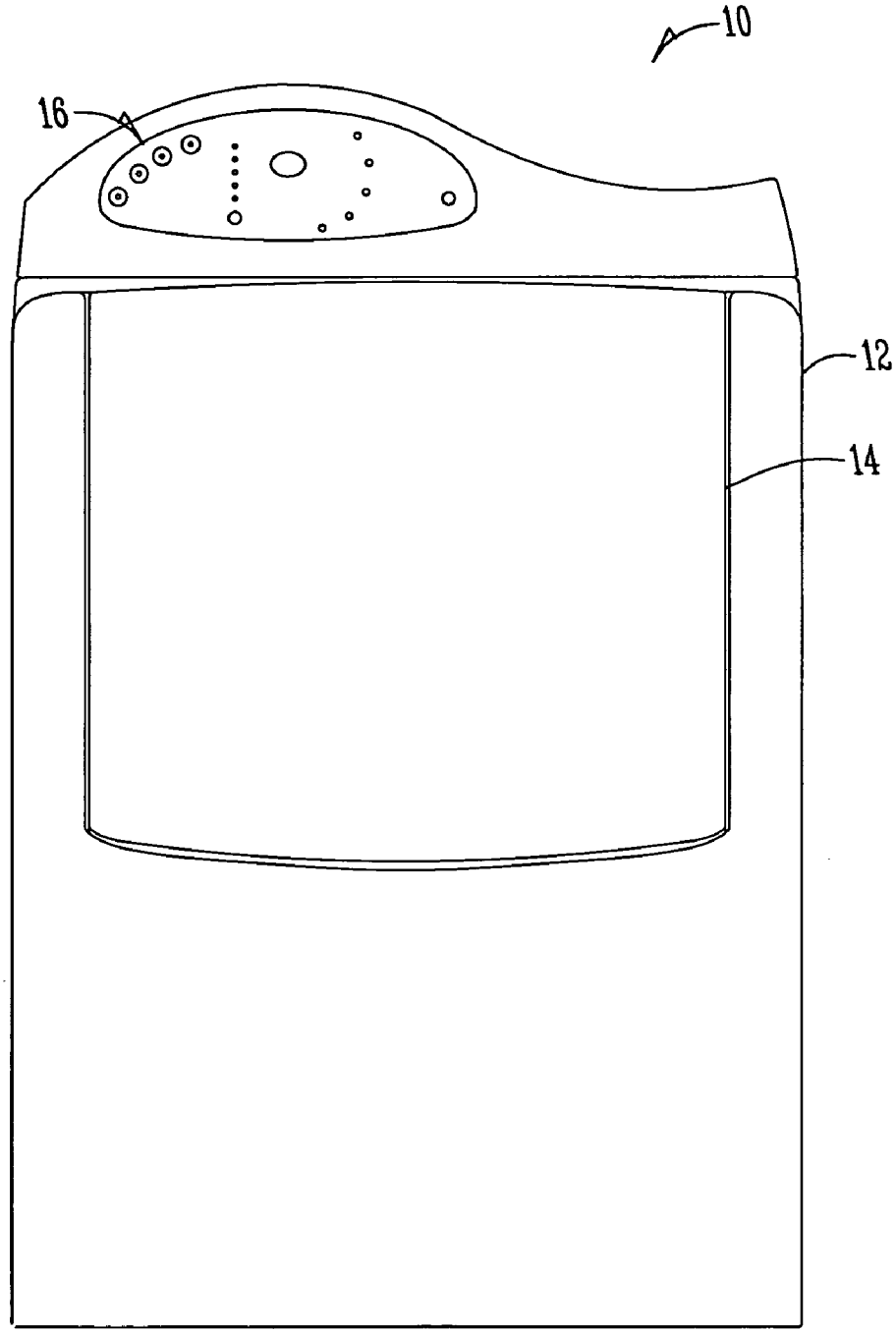
FIG. 1 illustrates a front view of one embodiment of a washing machine of the present invention.

FIG. 1 illustrates one embodiment of a washing machine of the present invention. However, other household appliances are contemplated with this invention. In FIG. 1, the washing machine 10 has a washing machine cabinet 12 and a washing machine door 14 for providing access to the inside of the washing machine cabinet 12. The washing machine 10 provides for functions typically associated with a washing machine. The washing machine 10 also includes a washing machine user interface 16. The washing machine user interface 16 uses bi-color LEDs to assist in communicating current settings and available selection options to a user.

Figure 2:
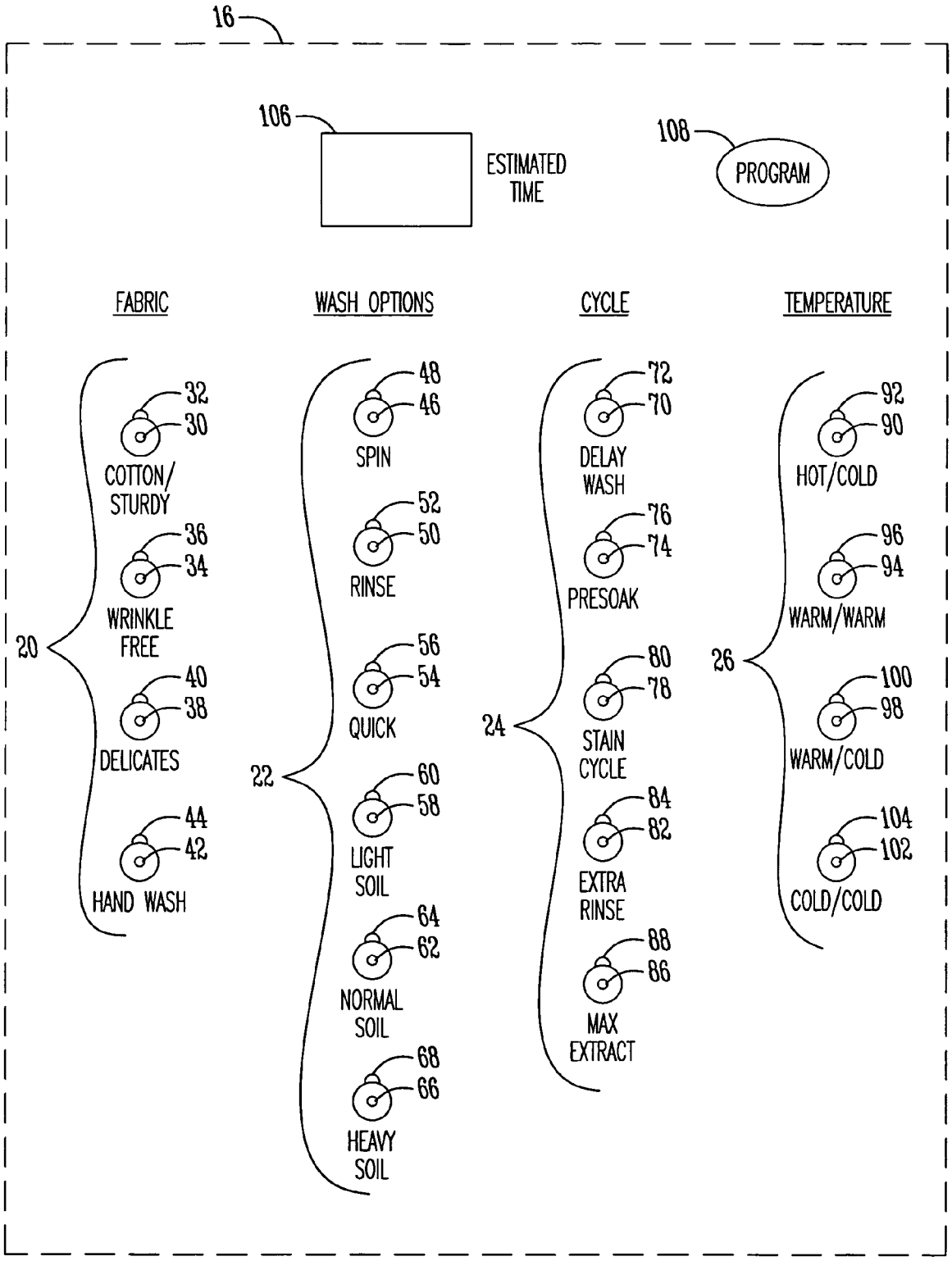
FIG. 2 illustrates one embodiment of a user interface according to the present invention.

One embodiment of a washing machine user interface is illustrated in FIG. 2. The present invention contemplates that the elements of the user interface 16 can be configured in numerous ways. The present invention is not to be limited to any specific configuration or arrangement of the particular elements of the user interface.

In FIG. 2, the user interface 16 provides for receiving a number of different appliance selection options for different settings. For example, these include a fabric option setting 20, a wash option setting 22, a cycle option setting 24, and a temperature option setting 26. For each setting, there are a plurality of buttons for selecting particular setting selection options. There is also a bi-colored LED associated with each button. The LED can indicate whether a particular setting option selection has been made or whether or not a particular setting option selection is available for selection. Preferably the button is a membrane switch. The term "bi-color" LED is defined to include any LED with two or more color states.

The fabric setting 20 includes a "cotton/sturdy" selection option button 30 with associated bi-color LED 32, "wrinkle free" selection option button 34 with associated LED 36, "delicates" selection option button 38 with associated LED 40, and "hand wash" selection option button 42 with associated LED 44.

Similarly, the wash options setting 22 includes "spin" selection option button 46 with associated LED 48, "rinse" selection option button 50 with associated LED 52, "quick" selection option button 54 with associated LED 56, "light soil" selection option button 58 with associated LED 60, "normal soil" selection option button 62 with associated LED 64, and "heavy soil" selection option button 66 with associated LED 68.

Similarly, the cycle selection 24 includes a "delay wash" selection option button 70 with associated LED 72, a "pre-soak" selection option button 74 with associated LED 76, "stain cycle" selection option button 78 with associated LED 80, "extra rinse" selection option button 82 with associated LED 84, and "max extract" selection option button 86 with associated LED 88.

Similarly, the temperature setting 26 includes "hot/cold" selection option button 90 and associated LED 92, "warm/warm" selection option button 94 with associated LED 96, "warm/cold" selection option button 98 with associated LED 100 and "cold/cold" selection option button 102 with associated LED 104. There is also a display 106. The display can be any type of display but preferably is an LED-type display. The display is used for displaying the estimated time left in a laundry cycle. The display 106 is also used along with the program button 108 in programming the settings.

In programming the settings, the washing machine, in this case, receives a press of the program button 108 from a user to initiate the programming cycle. At this point, a plurality of LEDs associated with the washing machine setting are lit. For example, all of the LEDs associated with the fabric setting, LED 32, 36, 40, and 44 are lit. The user then presses one of the washing machine selection option buttons that are lit to select the washing machine setting option to be associated with the washing machine fabric 20 setting. The remaining LEDs associated with the fabric setting 20 are then turned off while maintaining the LED associated with the washing machine setting option as lit. Thus, for example, after the program button 108 is selected, LEDs 32, 36, 40, and 44 are lit. A user then presses the cotton/sturdy button 30 at which point, the LED 32 remains lit and the LEDs 36, 40, and 44 switch off. The same methodology can be used with each of the other washing machine settings. Thus, for the wash options setting 22, LEDs 48, 52, 56, 60, 64, and 68 are lit. Then a user can select one of the buttons 46, 50, 54, 58, 62 and 66. The associated LED remains on while the remaining LEDs within the wash options selection 22 then turn off. Similarly, for selecting the cycle setting 24, LEDs 72, 76, 80, 84, and 88 turn on. The user then selects one of the buttons 70, 74, 78, 82, and 86. The LED associated with the button selected remains on while the remaining LEDs associated with the setting 24 turn off. Similarly, for the temperature setting 26, LEDs 92, 96, 100, and 104 all turn on. A user selects one of the buttons 90, 94, 98 and 102. The LED associated with the button selected remains lit while the other LEDs associated with temperature setting 26 turn off. In this manner, the user receives feedback that their selection has been made.

The use of bi-colored LEDs prevents failed programming. One user selection may preclude the availability of other user selections. Selections for example, a user selection of "hand wash" 42 may preclude the availability of various other selections, such as "stain cycle" 78, "max extract" 86 and "hot/cold" 90. Selections that are unavailable at any time or during programming or during the wash cycle are lit in a second color state such as a red color state. Available selections are lit in a first color state such as a green color state. Once a selection is made the LED associated with that selection remains in the first color state and the LEDs for the remaining selections turn off.

Once the operator or user has selected all of the desired settings, the operator presses the program button 108 a second time to retain or save the settings. Thus, in this manner, a user can program the settings of the appliance. The present invention provides for associating a name or a number with each group of saved settings. For example, a saved setting designated "1" includes a specific fabric setting, wash option, cycle settings, and temperature setting. The "1" designation can be displayed on the display 106. The present invention contemplates that a user can cycle through the various saved settings by pressing the program button 108 multiple times at initiation. Alternatively, separate user interface controls, such as buttons, could also be used. Thus, once a user has saved a particular combination of settings, the user can conveniently select the entire group of settings instead of needing to individually select each setting.

Figure 3:
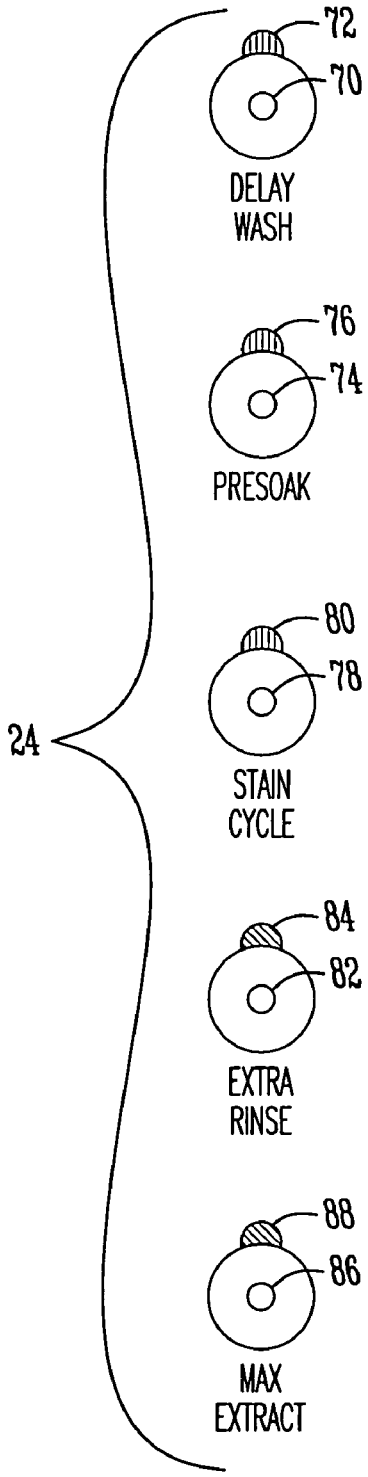
FIG. 3 illustrates one embodiment of a user interface of the present invention where bi-color LEDs are used.

FIG. 3 illustrates an exemplary cycle setting 24 for a washing machine, such as may be seen during an actual wash cycle. As shown in FIG. 3, LEDs 72, 76, and 80 are lit in a first color or have a first color state while LEDs 84 and 88 have a second color state. During a laundry cycle, the present invention contemplates that selection options that are no longer available are lit in a second color state. Thus, for example, during a wash cycle if it is too late to provide for delay wash, pre-soak, and stain cycle, then LEDs 72, 76, and 80 are lit in a second color state such as a red color state. However, if the point in cycle is still such that extra rinse and max extract can be selected then LEDs 84 and 88 are in an off state to indicate that a user can still select these options should the user now decide that these options are desirable. A first color state such as green may be used to indicate when an option has been selected. When two or more color states are associated with each LED in the user interface of the appliance, a user can quickly determine what options are available at any point in time. This provides an additional convenience to users.

Thus, a household appliance with a user interface with bi-colored LEDs has been disclosed. The present invention contemplates numerous variations in the manner in which the LEDs are used, the specific arrangement or configuration of the LEDs, the number and color of the color state, the manner in which the appliance is programmed, and other variations well within the spirit and scope of the invention.

What is claimed is:

1. A household appliance, comprising:

an appliance cabinet;

an appliance user interface comprising a program button and a plurality of appliance settings, each of the settings having a plurality of selection options, and a plurality of bi-color LEDs, each of the bi-color LEDs associated with one of the selection options;

wherein the user interface is adapted for receiving a first press of the program button, lighting the plurality of bi-color LEDs associated with the plurality of appliance selection options, receiving a selection of one or more buttons associated with the plurality of bi-color LEDs and the plurality of appliance selection options, and receiving a second press of the program button to indicate programming complete.

2. The appliance of claim 1 wherein the user interface is adapted to light one of the plurality of LEDs to a first color state to indicate that the selection option associated with the one of the plurality of LEDs is available for selection and adapted to light the one of the plurality of LEDs to a second color state to indicate that the selection option associated with the one of the plurality of LEDs is unavailable for selection.

3. The appliance of claim 2 wherein the one of the plurality of LEDs is lit to the first color state or the second color state during one of a plurality of operation cycles.

4. The appliance of claim 1 wherein each bi-color LED is disposed adjacent a membrane button.

5. The appliance of claim 1 wherein the appliance is configured as a laundry appliance.

6. The appliance of claim 1 wherein the appliance is configured as a washing machine.

7. A method for programming a household appliance, comprising:

(a) receiving a press of a program button from a user to initiate programming;

(b) lighting a plurality of LEDs associated with an appliance setting, each LED associated with one of a plurality of appliance setting selection option buttons, each LED being a bi-color LED;

(c) receiving a press of the appliance setting option button to select the appliance setting selection option LED associated with the appliance setting;

(d) turning off all LEDs associated with the appliance setting except maintaining the LED associated with the selected appliance setting selection option as lit;

(e) lighting all LEDs associated with the appliance setting selection options made unavailable by the selection made in the receiving step in a second color;

(f) receiving a second press of the program button from the user to retain the appliance setting.

8. The method of claim 7 further comprising displaying a number of cycles programmed on an estimated time display of the appliance.

9. The method of claim 7 performed upon a laundry appliance.

10. The method of claim 7 performed upon a washing machine.

11. A method of using bi-color LEDs in an appliance user interface comprising:

associating each of the bi-color LEDs with each of a plurality of selection options;

lighting the bi-color LEDs during an appliance operation cycle to a first color state to indicate chosen selection options and to a second color state to indicate selection options unavailable for selection;

using the bi-color LEDs during programming by (a) lighting all of the bi-color LEDs associated with a setting, (b) after receiving a user selection, turning off all bi-color LEDs associated with the setting except the bi-color LED associated with the setting. and (c) during programming, lighting LEDs associated with the setting to a first color state to indicate a chosen selection and to a second color state to indicate options made unavailable by the chosen selection.

12. The method of claim 11 wherein the appliance is a laundry appliance.

13. The method of claim 11 wherein the appliance is a washing machine.

* * * * *